US010398177B2

(12) United States Patent
Xiang

(10) Patent No.: US 10,398,177 B2
(45) Date of Patent: Sep. 3, 2019

(54) ELECTRONIC CIGARETTE AND A METHOD FOR CONTROLLING THE ELECTRONIC CIGARETTE

(71) Applicant: Shenzhen Kimsen Technology Co., Ltd, Shenzhen, Guangdong (CN)

(72) Inventor: Zhiyong Xiang, Guangdong (CN)

(73) Assignee: Shenzhen Kimsen Technology Co., Ltd, Shenzhen (CN)

( * ) Notice: Subject to any disclaimer, the term of this patent is extended or adjusted under 35 U.S.C. 154(b) by 37 days.

(21) Appl. No.: 15/539,726

(22) PCT Filed: Dec. 26, 2014

(86) PCT No.: PCT/CN2014/095083
§ 371 (c)(1),
(2) Date: Jun. 26, 2017

(87) PCT Pub. No.: WO2016/101248
PCT Pub. Date: Jun. 30, 2016

(65) Prior Publication Data

US 2017/0360097 A1 Dec. 21, 2017

(51) Int. Cl.
*A24F 11/00* (2006.01)
*A24F 13/00* (2006.01)
(Continued)

(52) U.S. Cl.
CPC ..... *A24F 47/008* (2013.01); *A24F 47/00* (2013.01); *F22B 1/284* (2013.01); *H05B 1/02* (2013.01); *H05B 1/0227* (2013.01)

(58) Field of Classification Search
CPC ..... A24F 47/008; A24F 47/00; A61M 15/06; H05B 1/02; F22B 1/284
(Continued)

(56) References Cited

U.S. PATENT DOCUMENTS

2015/0282526 A1* 10/2015 Wu ..... A61M 15/06 131/329
2015/0366266 A1* 12/2015 Chen ..... H05B 1/0244 131/328
(Continued)

FOREIGN PATENT DOCUMENTS

EP 2959786 A1 * 12/2015 ..... H05B 1/0244
WO WO 2016082077 A1 * 6/2016 ..... A24F 47/008

*Primary Examiner* — Abdullah A Riyami
*Assistant Examiner* — Thang H Nguyen

(57) ABSTRACT

The present invention relates to an electronic cigarette and a method for controlling the electronic cigarette. The method for controlling electronic cigarette comprises: reading the available smoking time when an atomization circuit of the electronic cigarette is in a turn-off state and the electronic cigarette detects a user's smoking action; determining whether or not the available smoking time is equal to or less than the first preset value to obtain a first determination result; when the first determination result is YES, outputting a prompt message to remind the user that e-liquid is almost to be exhausted, and outputting the available smoking time and/or available smoking times of the electronic cigarette; determining whether the available smoking time is greater than the second preset value to obtain a second determination result; controlling the atomization circuit to stay in the turn-off state when the second determination result is NO.

16 Claims, 8 Drawing Sheets

(51) Int. Cl.

| | |
|---|---|
| ***A24F 17/00*** | (2006.01) |
| ***A24F 25/00*** | (2006.01) |
| ***A24F 47/00*** | (2006.01) |
| ***F22B 1/28*** | (2006.01) |
| ***H05B 1/02*** | (2006.01) |

(58) Field of Classification Search
USPC ..... 131/328, 329
See application file for complete search history.

(56) References Cited

U.S. PATENT DOCUMENTS

| | | | | |
|---|---|---|---|---|
| 2017/0071262 | A1* | 3/2017 | Liu | A24F 47/00 |
| 2017/0231284 | A1* | 8/2017 | Newns | A24F 47/008 131/328 |

* cited by examiner

ELECTRONIC CIGARETTE AND A METHOD FOR CONTROLLING THE ELECTRONIC CIGARETTE

FIELD OF THE INVENTION

The present invention relates to the field of electrical cigarettes, and more particularly, relates to a charging method of electronic cigarettes and an electronic cigarette box.

BACKGROUND OF THE INVENTION

An electronic cigarette box is a device configured for storing electronic cigarettes. In addition, the electronic cigarette box can further use a rechargeable battery to store energy and charge a battery inside an electronic cigarette.

At present, there are generally two kinds of charge management methods for batteries inside electronic cigarettes. In one of the two methods, there is a charging management circuit in a charging circuit of an electronic cigarette, and an electronic cigarette box can adopt a 5V direct current (DC) voltage to charge a battery inside the electronic cigarette. In the other of the two methods, there is no charging management circuit in a charging circuit of an electronic cigarette, and an electronic cigarette box needs to charge a battery inside the electronic cigarette by means of using constant charging current and limiting a charging voltage to be not more than 4.2V charge.

From the above, if there is no charging management circuit in an electronic cigarette, but an electronic cigarette box directly uses the 5V DC voltage to charge a battery of the electronic cigarette, there is a risk of overcharging, and the battery of the electronic cigarette may be even caused to explode. If there is a charging management circuit in an electronic cigarette, but an electronic cigarette box charges a battery inside the electronic cigarette by means of using constant charging current and limiting a charging voltage to be not more than 4.2V, charging under charging may be caused, long charging time may be spent, and the needs of users are unable to be met well. In order to solve above problems, if an electronic cigarette box is provided with two different charging modules to charge the electronic cigarette with the charging management circuit and the electronic cigarette without the charging management circuit respectively, the cost is high, and user' needs are unable to be met well yet.

SUMMARY OF THE INVENTION

The present invention is directed to the technical problems existing in the prior art that the electronic cigarette can not accurately calculate the amount of the remaining e-liquid and the user can not be reminded with the amount of the current remaining e-liquid, to provide an electronic cigarette control method and an electronic cigarette to realize the following technical effects: to realize an accurate calculation of the amount of the remaining e-liquid in the electronic cigarette and an accurate control of the turn-turn-on and turn-off state of the atomization circuit, and when the e-liquid is almost to be exhausted, the electronic cigarette informs the user the amount of the current remaining e-liquid and reminds the user to replace the e-liquid in time to ensure that the user will not smoke scorched smell.

Technical Solution of Technical Problems

Technical Solution

On one aspect, the present invention provides an electronic cigarette control method, a memory of the electronic cigarette stores a first preset value and a second preset value which are relating to the amount of e-liquid, and available smoking time updated after each smoking to indicate the amount of current remaining e-liquid of the electronic cigarette, the second preset value is less than the first preset value; the method comprising following steps:

reading the available smoking time when an atomization circuit of the electronic cigarette is in a turn-off state and the electronic cigarette detects a user's smoking action;

determining whether or not the available smoking time is equal to or less than the first preset value to obtain a first determination result;

when the first determination result is YES, outputting a prompt message to remind the user that e-liquid is almost to be exhausted, and outputting the available smoking time and/or available smoking times of the electronic cigarette;

determining whether the available smoking time is greater than the second preset value to obtain a second determination result;

controlling the atomization circuit to stay in the turn-off state when the second determination result is NO.

Advantageously, after performing the step of determining whether or not the available smoking time is equal to or less than the first preset value to obtain a first determination result, the method further comprises following steps:

controlling the atomization circuit to turn on to atomize the e-liquid when the first determination result is NO, calculating a present smoking period and updating the available smoking time in the memory based on the present smoking period to obtain new available smoking time after a user's present smoking.

Advantageously, after performing step of determining whether the available smoking time is greater than the second preset value to obtain a second determination result, the method further comprises following steps:

controlling the atomization circuit to turn on to atomize the e-liquid when the second determination result is YES;

calculating a present smoking period and updating the available smoking time in the memory based on the present smoking period to obtain new available smoking time after a user's present smoking.

Advantageously, while performing the step of controlling the atomization circuit to stay in the turn-off state when the second determination result is NO, the method further comprises:

outputting a reminding message to remind the user that the e-liquid has been exhausted.

On the other aspect, the present invention further provides an electronic cigarette, the electronic cigarette comprises an atomizing assembly and a battery assembly;

the atomizing assembly is provided with an interface circuit, an atomization circuit and a main circuit; the interface circuit is configured for detachably connecting to the battery assembly, the atomization circuit and the main circuit are connected to the interface circuit;

the main circuit is configured for calculating available smoking time based on actual turn-on time of the atomization circuit after being electrically connected to the battery assembly through the interface circuit, so that when the available smoking time is less than or equal to the first preset value, a prompt message is outputted to remind a user that e-liquid is almost to be exhausted and the available smoking time and/or available smoking times of the electronic cigarette is outputted; and when the available smoking time is less than or equal to a second preset value, the atomization circuit is controlled to be in a turn-off state.

Advantageously, the main circuit is configured for calculating the available smoking time based on the actual turn-on time of the atomization circuit, and providing the available smoking time to the battery assembly when being electrically connected to the battery assembly;

the battery assembly is configured for outputting the prompt message to remind the user that e-liquid is almost to be exhausted and outputting the available smoking time and/or the available smoking times of the electronic cigarette, when the available smoking time is less than or equal to the first preset value; and the main circuit or the battery assembly is further configured to control the atomization circuit to be in the turn-off state when the available smoking time is less than or equal to the second preset value.

Advantageously, the battery assembly is configured for controlling the atomization circuit to turn on to atomize the e-liquid when the available smoking time is greater than the first preset value, and the battery assembly is further configured for calculating a present smoking period and updating the available smoking time in the main circuit based on the present smoking period to obtain new available smoking time after a user's present smoking.

Advantageously, the main circuit or the battery assembly is configured for controlling the atomization circuit to turn on to atomize the e-liquid when the available smoking time is less than or equal to the first preset value and greater than the second preset value, and the main circuit or the battery assembly is further configured for calculating a present smoking period and updating the available smoking time in the main circuit based on the present smoking period to obtain new available smoking time after a user's present smoking.

Advantageously, the main circuit is a memory integrated circuit that provides the available smoking time to the battery assembly through the interface circuit; and the battery assembly is configured for outputting the prompt message to remind the user that e-liquid is almost to be exhausted, and outputting the available smoking time and/or available smoking times of the electronic cigarette, when the available smoking time is less than or equal to the first preset value; the battery assembly is further configured for controlling the atomization circuit to be in the turn-off state when the available smoking time is less than or equal to the second preset value.

Advantageously, the main circuit comprises a processing chip in which a nonvolatile memory is defined;

the nonvolatile memory is configured for calculating the available smoking time based on the actual turn-on time of the atomization circuit, and the nonvolatile memory is further configured for providing the available smoking time to the battery assembly when being electrically connected to the battery assembly, so that when the available smoking time is less than or equal to the first preset value, the battery assembly outputs the prompt message to remind the user that e-liquid is almost to be exhausted and outputs the available smoking time and/or the available smoking times of the electronic cigarette; and the processing chip further comprises a control module connected to the atomization circuit and configured for obtaining the available smoking time from the nonvolatile memory after being electrically connected to the battery assembly through the interface circuit, and the control module is further configured for directly controlling the atomization circuit to be in the turn-off state when the available smoking time is less than or equal to the second preset value.

Advantageously, the atomization circuit comprises a switch; and therein the control module controls the switch to be in a turn-off state when the available smoking time is less than or equal to the second preset value, thereby realizing the turn-off state of the atomization circuit.

Advantageously, the main circuit comprises:

an external memory configured for calculating the available smoking time based on the actual turn-on time of the atomization circuit, and providing the available smoking time to the battery assembly when being electrically connected to the battery assembly, so that when the available smoking time is less than or equal to the first preset value, the battery assembly outputs the prompt message is to remind the user that e-liquid is almost to be exhausted and outputs the available smoking time and/or available smoking times of the electronic cigarette;

a control chip connected to the external memory and the atomization circuit, the control chip is configured for obtaining the available smoking time from the external memory after being electrically connected to the battery assembly through the interface circuit, and the control chip is further configured for directly controlling the atomization circuit to be in the turn-off state when the available smoking time is less than or equal to the second preset value.

Advantageously, the atomizing assembly further comprises:

a current detection circuit connected to the atomization circuit and the main circuit, the current detection circuit is configured for detecting a current signal of the atomization circuit after that the main circuit and the battery assembly are electrically connected to each other, and then feeding back an actual turn-on situation of the atomization circuit to the main circuit based on the current signal.

Advantageously, the battery assembly comprises:

a power supply circuit;

a smoking action detection circuit connected to the power supply circuit;

a microcontroller connected to the power supply circuit and the smoking action detection circuit and configured for obtaining the available smoking time from the main circuit when the smoking action detection circuit detects a user's smoking action;

a display screen connected to the power supply circuit and the microcontroller for displaying relevant information of the electronic cigarette when necessary;

the microcontroller compares the available smoking time with the first preset value, when the available smoking time is less than or equal to the first preset value, the microcontroller generates the prompt message configured for controlling the display screen to display to remind the user that the e-liquid is almost to be exhausted, and the microcontroller further outputs a control command of the available smoking time and/or the available smoking times of the electronic cigarette and sends the control command to the display screen.

Advantageously, the battery assembly comprises:

a power supply circuit;

a smoking action detection circuit connected to the power supply circuit;

a microcontroller connected to the power supply circuit and the smoking action detection circuit and configured for obtaining the available smoking time from the main circuit when the smoking action detection circuit detects a user's smoking action;

a wireless communication module connected to the power supply circuit and the microcontroller for transmitting relevant information of the electronic cigarette to an external device by wireless communication, if necessary;

the microcontroller compares the available smoking time with the first preset value, when the available smoking time is less than or equal to the first preset value, the microcontroller generates the prompt message configured for controlling the wireless communication module to output to the external device to remind the user that the e-liquid is almost to be exhausted, and the microcontroller further outputs a control command of the available smoking time and/or the available smoking times of the electronic cigarette and sends the control command to the wireless communication module.

Advantageously, the wireless communication module is a Bluetooth transceiver module.

Advantageously, the battery assembly is further configured to output a reminding message for reminding the user that the e-liquid has been exhausted when the electronic cigarette controls the atomization circuit to be in a turn-off state based on the available smoking time.

ADAVANTAGES OF THE PRESENT INVENTION

Adavantages

In the present invention, a memory of the electronic cigarette stores a first preset value and a second preset value which are relating to the amount of e-liquid, and available smoking time updated after each smoking to indicate the amount of current remaining e-liquid of the electronic cigarette, the second preset value is less than the first preset value; reading the available smoking time when an atomization circuit of the electronic cigarette is in a turn-off state and the electronic cigarette detects a user's smoking action; determining whether or not the available smoking time is equal to or less than the first preset value, when a determination result is YES, outputting a prompt message to remind the user that e-liquid is almost to be exhausted, and outputting the available smoking time and/or available smoking times of the electronic cigarette; determining whether the available smoking time is greater than the second preset value; controlling the atomization circuit to remain in the turn-off state when a determination result is NO. That is, a calculation of the amount of the remaining e-liquid is more accurate by calculating and storing the available smoking time indicating the amount of the current remaining e-liquid of the electronic cigarette and updating the available smoking time after each user's smoking; In addition, every time the user smokes, the available smoking time is read and compared with the first preset value (i.e., usage time corresponding to a low level of the e-liquid), and when the available smoking time is less than or equal to the first preset value, the prompt message is outputted to remind the user that e-liquid is almost to be exhausted, and the available smoking time and/or the available smoking times of the electronic cigarette are outputted as well, so that the user can visually know the amount of the remaining e-liquid and can be ready to replace the e-liquid in time; Further, comparing the available smoking time with a second preset value (i.e., usage time corresponding to the minimum usable amount of the e-liquid) and controlling the atomizing assembly to stay in a turn-off state when the available smoking time is less than or equal to the second preset value. It solves the technical problem that the electronic cigarette can not accurately calculate the amount of the remaining e-liquid and the user can not be reminded with the amount of the current remaining e-liquid, and realizes the following technical effects: to realize an accurate calculation of the amount of the remaining e-liquid in the electronic cigarette and an accurate control of the turn-on and turn-off state of the atomization circuit, and when the e-liquid is almost to be exhausted, the electronic cigarette informs the user the current remaining e-liquid and reminds the user to replace the e-liquid in time to ensure that the user will not smoke scorched smell.

BRIEF DESCRIPTION OF THE DRAWINGS

In order to illustrate the embodiments of the present invention or the technical solutions in the prior art more clearly, the following drawings, which are to be used in the description of the embodiments or the prior art, will be briefly described. It will be apparent that the drawings in the following description is only an embodiment of the present invention, and for one skilled in the art, other drawings may be obtained in accordance with the provided drawings without departing from the inventive work.

DETAILED DESCRIPTION OF THE PREFERRED EMBODIMENT

Figure 1:
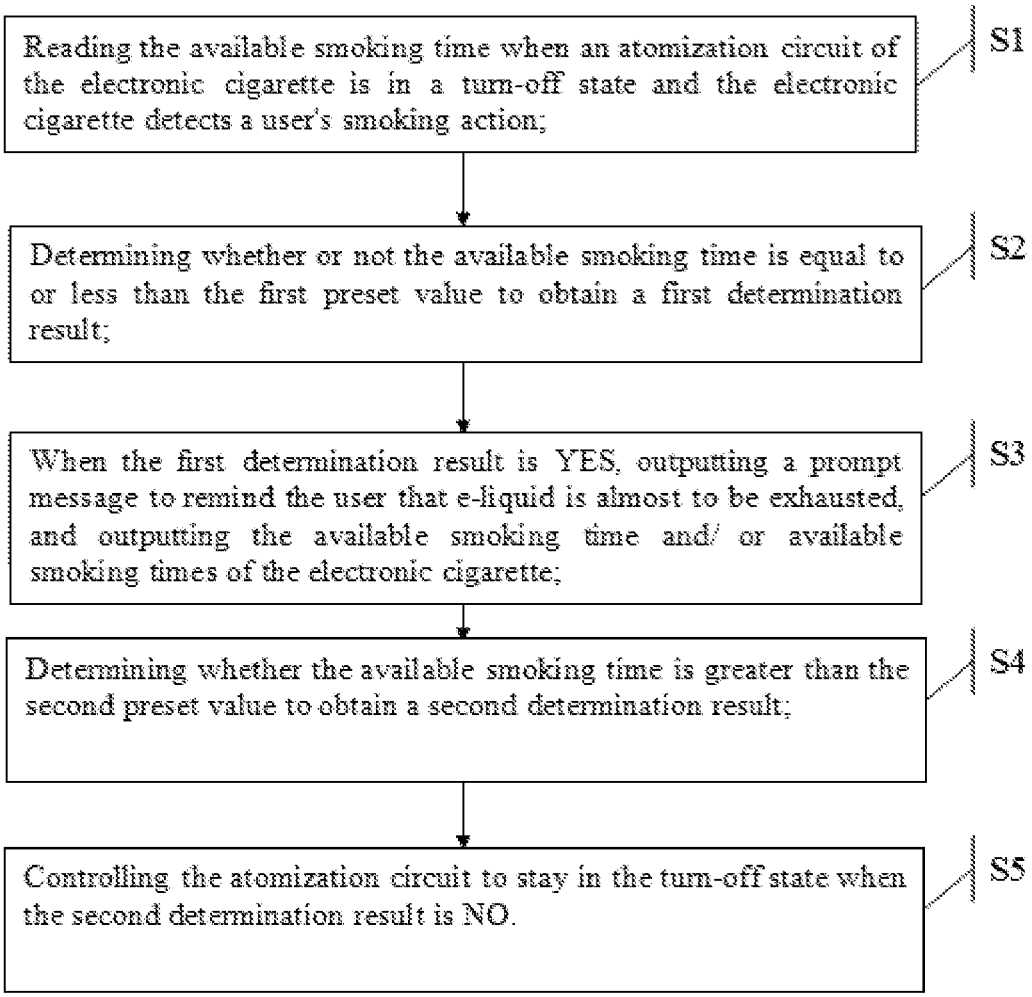
FIG. 1 is a flow chart of a first type of the electronic cigarette control method according to an embodiment of the present invention.

The embodiment of the present invention provides an electronic cigarette control method which solves the technical problem that the electronic cigarette can not accurately calculate the amount of the remaining e-liquid and can not remind the user of the current remaining e-liquid in the prior art, the electronic cigarette control method realizes the accurate calculation of the current remaining e-liquid, the accurate control the turn-on and turn-off state of the atomization circuit, and when the e-liquid is almost to be exhausted, the user is reminded of the current remaining e-liquid and reminded to replace the e-liquid in time to ensure the technical effect that the user will not smoke scorched odor.

The technical solution of the embodiment of the present invention is to solve the above technical problems, a general idea is as follows:

The embodiment of the present invention provides an electronic cigarette control method, a memory of the electronic cigarette stores a first preset value and a second preset value which are relating to the amount of e-liquid, and available smoking time updated after each smoking to indicate the amount of current remaining e-liquid of the electronic cigarette, the second preset value is less than the first preset value; the method comprising following steps: reading the available smoking time when an atomization circuit of the electronic cigarette is in a turn-off state and the electronic cigarette detects a user's smoking action; determining whether or not the available smoking time is equal to or less than the first preset value to obtain a first determination result; when the first determination result is YES, outputting a prompt message to remind the user that e-liquid is almost to be exhausted, and outputting the available smoking time and/or available smoking times of the electronic cigarette; determining whether the available smoking time is greater than the second preset value to obtain a second determination result; controlling the atomization circuit to remain in the turn-off state when the second determination result is NO.

It can be seen that in the embodiment of the present invention, the calculation of the amount of the remaining e-liquid is more accurate by calculating and storing the available smoking time indicating the amount of the current remaining e-liquid of the electronic cigarette and updating the available smoking time after each user's smoking, In addition, every time the user smokes, the available smoking time is read and compared with the first preset value (i.e., usage time corresponding to a low level of the e-liquid), and when the available smoking time is less than or equal to the first preset value, the prompt message is outputted to remind the user that e-liquid is almost to be exhausted, and the available smoking time and/or the available smoking times of the electronic cigarette are outputted as well, so that the user can visually know the amount of the remaining e-liquid and can be ready to replace the e-liquid in time. Further, comparing the available smoking time with a second preset value (i.e., usage time corresponding to the minimum usable amount of the e-liquid) and controlling the atomizing assembly to stay in the turn-off state when the available smoking time is less than or equal to the second preset value. It solves the technical problem that the electronic cigarette can not accurately calculate the amount of the remaining e-liquid and the user can not be reminded of the amount of the current remaining e-liquid, and realizes the following technical effects: to realize the accurate calculation of the amount of the remaining e-liquid in the electronic cigarette and an accurate control of the turn-on and turn-off state of the atomization circuit, and when the e-liquid is almost to be exhausted, the electronic cigarette informs the user the current remaining e-liquid and reminds the user to replace the e-liquid in time to ensure that the user will not smoke the scorched smell.

In order to well understand the above-described technical solution, the above-described technical solution will be described in detail with reference to the accompanying drawings and specific embodiments, and it is to be understood that the specific features of the embodiments and embodiments of the present invention are all detailed descriptions of the technical solution of the present application and are not intended to limit the technical solution of the present application, and in the absence of a conflict, the embodiments of the present invention and the technical features of the embodiments can be combined with each other.

First Embodiment

Referring to FIG. 1, the embodiment of the present invention provides an electronic cigarette control method in which a memory of the electronic cigarette stores a first preset value and a second preset value which are relating to the amount of e-liquid, and available smoking time updated after each smoking to indicate the amount of current remaining e-liquid of the electronic cigarette. The first predetermined value may be usage time corresponding to a low level of the e-liquid in the electronic cigarette, and the low level of the e-liquid is specific to 1/n of the initial amount of e-liquid in the electronic cigarette, and n may be an integer of 3, 4, 5 and the like, and is not specifically limited; the second preset value is usage time corresponding to the minimum usable amount of the e-liquid, and the second preset value is less than the first preset value; the method comprising the following steps:

reading the available smoking time when an atomization circuit of the electronic cigarette is in a turn-off state and the electronic cigarette detects a user's smoking action;

determining whether or not the available smoking time is equal to or less than the first preset value to obtain a first determination result;

when the first determination result is YES, outputting a prompt message to remind the user that e-liquid is almost to be exhausted, and outputting the available smoking time and/or available smoking times of the electronic cigarette;

determining whether the available smoking time is greater than the second preset value to obtain a second determination result;

controlling the atomization circuit to remain in the turn-off state when the second determination result is NO.

Therein the atomizing assembly is in the turn-off state, specifically refers to that an atomization heating wire in the atomizing assembly is disconnected from the power source and can not work to generate heat; in the step of when the first determination result is YES, outputting a prompt message to remind the user that e-liquid is almost to be exhausted, and outputting the available smoking time and/or available smoking times of the electronic cigarette, outputting available smoking times helps the user more intuitive to know how much times the remaining e-liquid can be smoked, so that the user can plan to replace the e-liquid according to their own smoking frequency.

Figure 2:
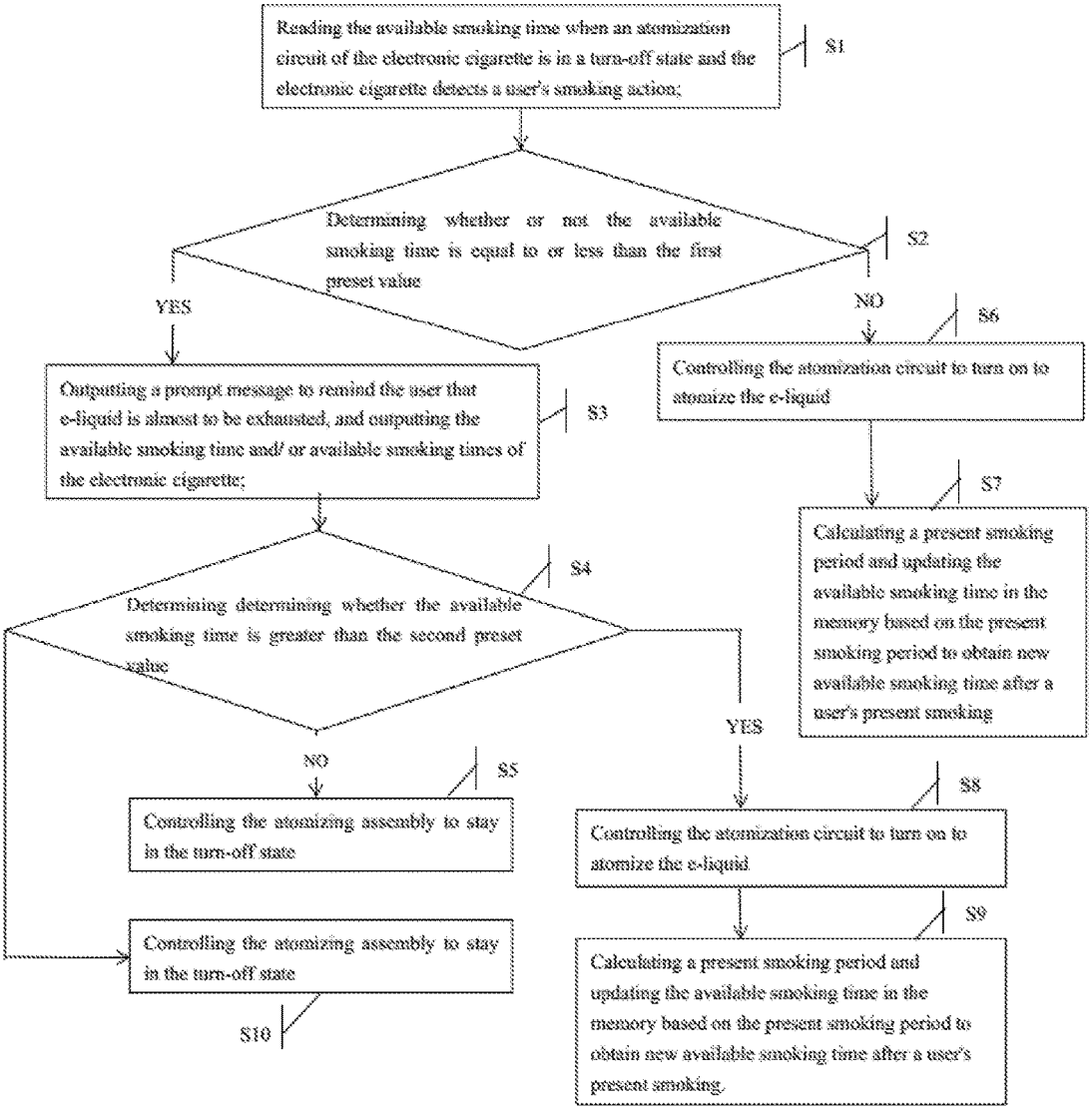
FIG. 2 is a flow chart of a second type of the electronic cigarette control method according to an embodiment of the present invention.

Further, referring to FIG. 2, after performing the step of determining whether or not the available smoking time is equal to or less than the first preset value to obtain a first determination result, the method further comprises following steps to ensure the atomization heating wire is electrically powered to work when it is determined that the current remaining e-liquid in the atomizing assembly of the electronic cigarette is greater than the minimum usable amount of the e-liquid, and also to ensure that after the present time that the atomization heating wire is electrically powered, the amount of the remaining e-liquid is recalculated and the available smoking time stored before is replaced by new available smoking time corresponding to the amount of the remaining e-liquid.

controlling the atomization circuit to turn on to atomize the e-liquid when the first determination result is NO, calculating a present smoking period and updating the available smoking time in the memory based on the present smoking period to obtain new available smoking time after a user's present smoking.

Still referring to FIG. 2, after performing the step of determining whether the available smoking time is greater than the second preset value to obtain a second determination result, the method further comprises following steps to ensure the atomization heating wire is electrically powered to work when it is determined that the current remaining e-liquid in the atomizing assembly of the electronic cigarette is less than or equal to the minimum usable amount of the e-liquid, and then the current remaining e-liquid in the atomizing assembly of the electronic cigarette is greater than the minimum usable amount of the e-liquid; and also to ensure after that the present time that the atomization heating wire is electrically powered, the amount of the remaining e-liquid is recalculated and the available smoking time stored before is replaced by new available smoking time corresponding to the amount of the remaining e-liquid.

controlling the atomization circuit to turn on to atomize the e-liquid when the second determination result is YES;

calculating a present smoking period and updating the available smoking time in the memory based on the present smoking period to obtain new available smoking time after a user's present smoking.

Referring to FIG. 2, in a specific implementation process, in order to remind the user when the e-liquid in the electronic cigarette is exhausted and the atomization heating wire stops working, while performing the step of controlling the atomization circuit to remain in the turn-off state when the second determination result is NO, the method further comprises step of outputting a reminding message to remind the user that the e-liquid has been exhausted.

In summary, by accurately calculating the available smoking time of the electronic cigarette, the present application can accurately calculate the amount of the remaining e-liquid, accurately control the turn-on and turn-off state of the atomization circuit and remind the user of the current remaining e-liquid so that the user can replace the smoke e-liquid (that is, replace the atomizing assembly) when the e-liquid is almost to be exhausted, so as to ensure that the user will not smoke the scorched smell, thereby enhancing experience of the user.

Second Embodiment

Figure 3:
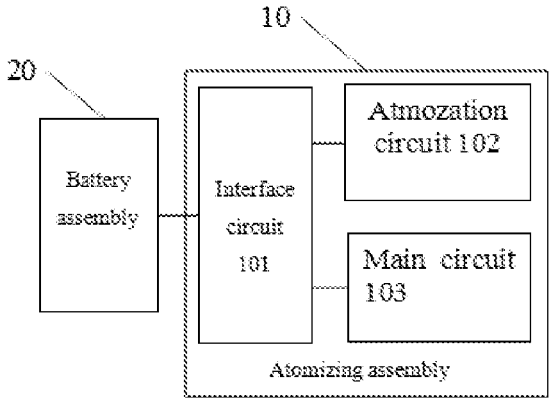
FIG. 3 is a structural block diagram showing the structure of a first type of the electronic cigarette provided by an embodiment of the present invention.

Based on the same inventive concept, referring to FIG. 3, the embodiment of the present invention also provides an electronic cigarette comprising an atomizing assembly 10 and a battery assembly 20;

The atomizing assembly 10 is provided with an interface circuit 101, an atomization circuit 102 and a main circuit 103; the interface circuit 101 is configured for detachably connecting to the battery assembly 20, the atomization circuit 102 and the main circuit 103 are connected to the interface circuit 101;

The main circuit 103 is configured for calculating available smoking time based on actual turn-on time of the atomization circuit 102 after being electrically connected to the battery assembly 20 through the interface circuit 101, so that when the available smoking time is less than or equal to the first preset value, a prompt message is outputted to remind a user that e-liquid is almost to be exhausted and the available smoking time and/or available smoking times of the electronic cigarette is outputted; and when the available smoking time is less than or equal to a second preset value, the atomization circuit 102 is controlled to be in a turn-off state.

In the present embodiment, similar to the first embodiment, a memory of the electronic cigarette stores a first preset value and a second preset value which are relating to the amount of e-liquid, and available smoking time updated after each smoking to indicate the amount of current remaining e-liquid of the electronic cigarette. The first predetermined value may be usage time corresponding to a low level of the e-liquid in the electronic cigarette, and the low level of the e-liquid is specific to 1/n of the initial amount of e-liquid in the electronic cigarette, and n may be an integer of 3, 4, 5 and the like, and is not specifically limited; the second preset value is usage time corresponding to the minimum usable amount of the e-liquid, and the second preset value is less than the first preset value. It is to be noted that the available smoking time, the first preset value and the second preset value can be set according to e-liquid composition, e-liquid volume of the electronic cigarette, and statistical amount of of e-liquid consumed in each smoking time; for instance, the available smoking time is 24 hours, the first preset value is 4 hours and the second preset value is 30 seconds, and there is no specific limitation here.

Figure 4:
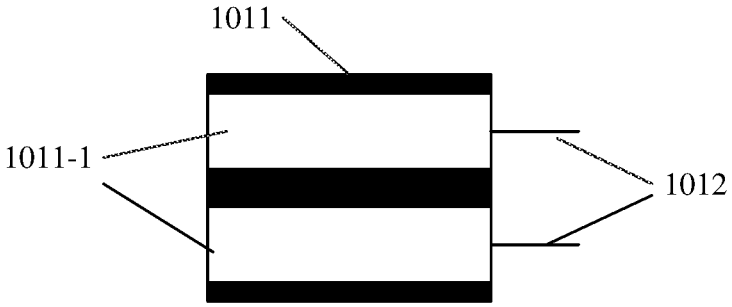
FIG. 4 is a schematic diagram of the configuration of an interface circuit of an atomizing assembly provided in the embodiment of the present invention.

In the present embodiment, the atomizing assembly 10 and the battery assembly 20 of the electronic cigarette can be detachably connected through the interface circuit 101; Specifically, referring to FIG. 4, the interface circuit 101 comprises a connecting member 1011 and a plurality of connecting wires 1012 connected from the connecting member 1011 to connect the atomization circuit 102 and the main circuit 103. As shown in FIG. 4, the connecting member 1011 is a series connector, and side-by-side series connecting holes 1011-1 are provided on the series connector. Correspondingly, the battery assembly 20 is provided with a pin header arranged to match with the series connector, inserting the pin header into or out of the series connecting holes 1011-1 to achieve a detachable connection between the battery assembly 20 and the atomizing assembly 10; therein the number of the series connecting holes 1011-1 is dependent on the particular situation; for instance, the battery assembly 20 supplies electrical power to the atomizing assembly 10 primarily through the interface circuit 101, and the series connecting holes 1011-1 comprises two holes for the power supply and ground.

Figure 5:
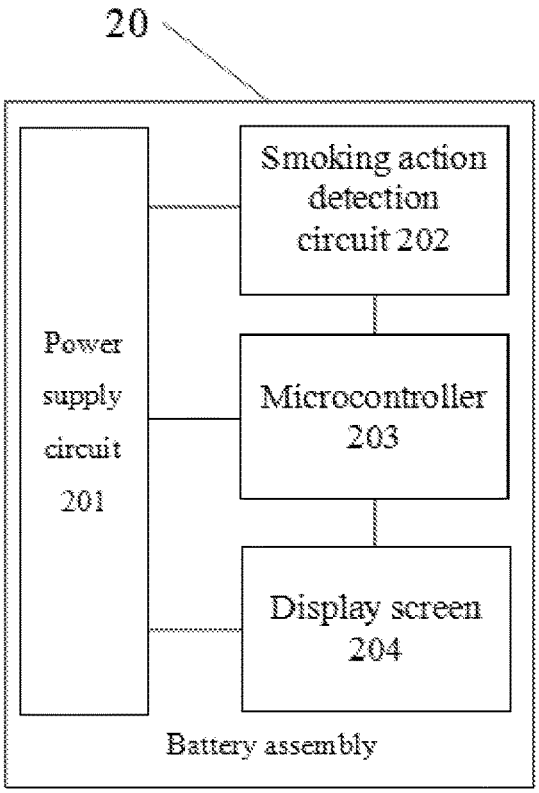
FIG. 5 is a schematic view of a first type of a battery assembly according to the embodiment of the present invention.

In the specific implementation process, referring to FIG. 5, the battery assembly 20 comprises a power supply circuit 201 and a smoking action detection circuit 202 which is connected to the power supply circuit 201 for detecting a user's smoking action. The smoking action detection circuit 202 is provided with an air flow sensor or a touch switch, and is not specifically limited thereto. When the user's smoking action is detected by the smoking action detection circuit 202, and the battery assembly 20 is physically connected to the atomizer assembly 10 through the interface circuit 101, the power supply circuit 201 supplies power to the main circuit 103 through the interface circuit 101. The main circuit 103 calculates the available smoking time based on actual turn-on time of the atomization circuit 102. The term "actual turn-on" as used herein means electrical energy effective in atomizing the e-liquid and acquired from the battery assembly 20 by the atomization circuit 102.

In a specific implementation process, the main circuit 103 is configured for calculating the available smoking time based on the actual turn-on time of the atomization circuit 102, and providing the available smoking time to the battery assembly 20 when being electrically connected to the battery assembly 20; the battery assembly 20 is configured for outputting the prompt message to remind the user that e-liquid is almost to be exhausted and outputting the available smoking time and/or the available smoking times of the electronic cigarette, when the available smoking time is less than or equal to the first preset value; the main circuit 103 or the battery assembly 20 is further configured to control the atomization circuit 102 to be in the turn-off state when the available smoking time is less than or equal to the second preset value.

In addition, the battery assembly 20 is further configured for controlling the atomization circuit 102 to turn on to atomize the e-liquid when the available smoking time is greater than the first preset value. The battery assembly 20 is further configured for calculating a present smoking period and updating the available smoking time in the main circuit 103 based on the present smoking period to obtain new available smoking time after a user's present smoking. The main circuit 103 or the battery assembly 20 is configured for controlling the atomization circuit 102 to turn on to atomize the e-liquid when the available smoking time is less than or equal to the first preset value and greater than the second preset value, and the main circuit 103 or the battery assembly 20 is further configured for calculating a present smoking period and updating the available smoking time in the main circuit 103 based on the present smoking period to obtain new available smoking time after a user's present smoking.

Namely, in the present embodiment, the electronic cigarette mainly performs the following two functions based on the available smoking time: (1) information outputting; (2) controlling the atomization circuit 102 to turn off, and controlling the atomization circuit 102 to turn on and update the available smoking time. The above function (1) is realized by the battery assembly 20; and the above function (2) is realized by the battery assembly 20 and/or the main circuit 103. Detailed descriptions are shown as following:

(1) Information outputting, namely, outputting the prompt message to remind the user that e-liquid is almost to be exhausted, and outputting the available smoking time and/or available smoking times of the electronic cigarette; and this function is performed by the battery assembly 20.

A, the battery assembly 20 displays the outputting information through its own display screen, referring to FIG. 5, the battery assembly 20 comprises a power supply circuit 201; a smoking action detection circuit 202 connected to the power supply circuit 201; a microcontroller 203 connected to the power supply circuit 201 and the smoking action detection circuit 202 and configured for obtaining the available smoking time from the main circuit 103 when the smoking action detection circuit 202 detects a user's smoking action; a display screen 204 connected to the power supply circuit 201 and the microcontroller 203 for displaying relevant information of the electronic cigarette when necessary; the microcontroller 203 compares the available smoking time with the first preset value, when the available smoking time is less than or equal to the first preset value, the microcontroller 203 generates the prompt message configured for controlling the display screen 204 to display to remind the user that the e-liquid is almost to be exhausted, and the microcontroller 203 further outputs a control command of the available smoking time and/or the available smoking times of the electronic cigarette and sends the control command to the display screen 204.

Specifically, a model of the microcontroller 203 may be STM32F030, and the display screen 204 may be made of an organic light-emitting diode (OLED), a liquid crystal display (LCD), a light-emitting diode (LED) Screen or LED light array. The principle that the battery assembly 20 performs the outputting information is that the microcontroller 203 reads the available smoking time from the main circuit 103 every time the user's smoking action is detected by the smoking action detection circuit 202 and compares the available smoking time with the first preset value, when the available smoking time is less than or equal to the first preset value, the prompt message or alarm information is displayed on the display screen 204 to remind the user that the e-liquid in the atomizing assembly 10 is almost to be exhausted and e-liquid replacement is needed to be prepared.

Figure 6:
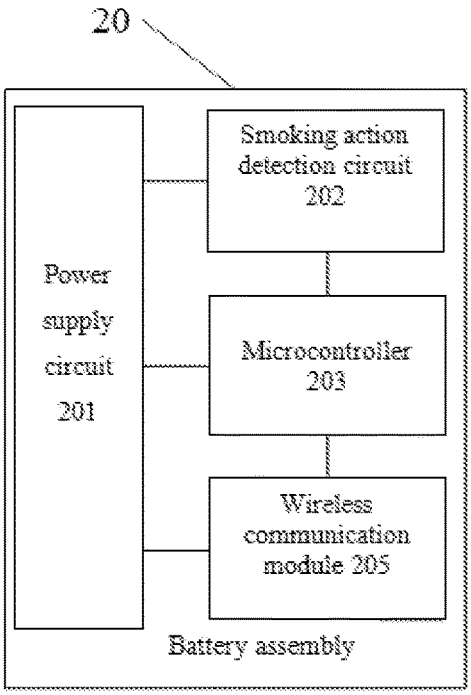
FIG. 6 is a schematic view of a second type of a battery assembly according to the embodiment of the present invention.

B, the battery assembly 20 displays the outputting information by an external device, referring to FIG. 6, the battery assembly 20 comprises a power supply circuit 201; a smoking action detection circuit 202 connected to the power supply circuit 201; a microcontroller 203 connected to the power supply circuit 201 and the smoking action detection circuit 202 and configured for obtaining the available smoking time from the main circuit 103 when the smoking action detection circuit 202 detects a user's smoking action; a wireless communication module 205 connected to the power supply circuit 201 and the microcontroller 203 for transmitting relevant information of the electronic cigarette to an external device by wireless communication, if necessary; the microcontroller 203 compares the available smoking time with the first preset value, when the available smoking time is less than or equal to the first preset value, the microcontroller 203 generates the prompt message configured for controlling the wireless communication module 205 to output to the external device to remind the user that the e-liquid is almost to be exhausted, and the microcontroller 203 further outputs a control command of the available smoking time and/or the available smoking times of the electronic cigarette and sends the control command to the wireless communication module 205; therein the wireless communication module 205 may be a Bluetooth transceiver module.

Specifically, when the wireless communication module 205 is a Bluetooth transceiver module, the microcontroller 203 and the Bluetooth transceiver module can be implemented by an integrated circuit chip, a model of the integrated circuit chip may be nRF51822. Then the principle that the battery assembly 20 performs the outputting information is substantially the same as that of the case A described above, differences are shown as following: the battery assembly 20 itself does not perform information display, and the microcontroller 203 compares the readable available smoking time with the first preset value, when the available smoking time is less than or equal to the first preset value, the microcontroller 203 connects to an application program (APP) terminal via the Bluetooth transceiver module, and displays the amount of the remaining e-liquid in the atomizing assembly and the prompt message on the APP terminal.

In addition, the battery assembly 20 is further configured to output a reminding message for reminding the user that the e-liquid has been exhausted when the electronic cigarette controls the atomization circuit 102 to be in a turn-off state based on the available smoking time.

(2) controlling the atomization circuit 102 to turn off, and controlling the atomization circuit 102 to turn on and update the available smoking time; this function is achieved by the battery assembly 20 and/or the main circuit 103.

1) Case 1: This function is controlled by the battery assembly 20; in this case, the main circuit 103 has only a storage function for storing the available smoking time.

Specifically, the main circuit 103 is a memory integrated circuit that provides the available smoking time to the battery assembly 20 through the interface circuit 101; the battery assembly 20 is configured for outputting the prompt message to remind the user that e-liquid is almost to be exhausted, and outputting the available smoking time and/or available smoking times of the electronic cigarette, when the available smoking time is less than or equal to the first preset value; the battery assembly 20 is further configured for controlling the atomization circuit 102 to be in a turn-off state when the available smoking time is less than or equal to the second preset value. That is, the first and second preset values are pre-stored in the battery assembly 20.

Further, during the specific implementation, the battery assembly 20 is configured for controlling the atomization circuit 102 to turn on to atomize the e-liquid when the available smoking time is greater than the first preset value, and the battery assembly 20 is further configured for calculating a present smoking period and updating the available smoking time in the memory based on the present smoking period to obtain new available smoking time after a user's present smoking; or the battery assembly 20 is configured for controlling the atomization circuit 102 to turn on to atomize the e-liquid when the available smoking time is less than or equal to the first preset value and greater than the second preset value, and the battery assembly 20 is further configured for calculating a present smoking period and updating the available smoking time in the memory based on the present smoking period to obtain new available smoking time after a user's present smoking.

Figure 7:
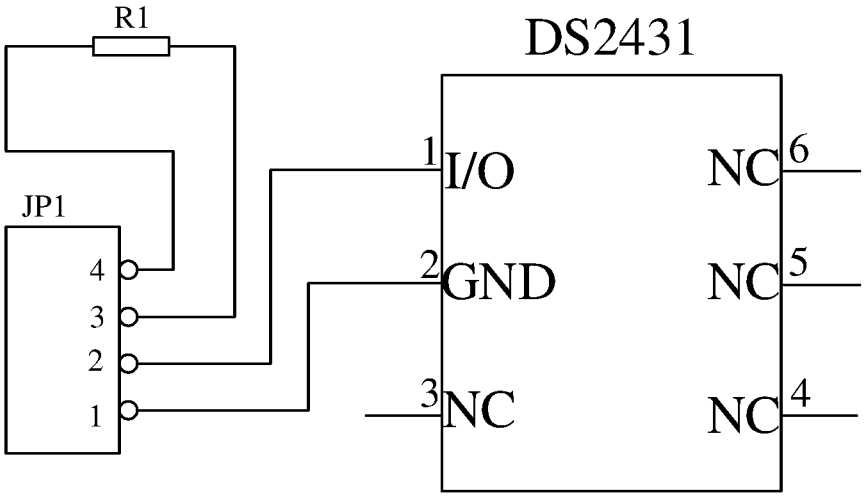
FIG. 7 is a circuit principle diagram of an atomizing assembly based on a memory integrated circuit according to the embodiment of the present invention.

Referring to FIG. 7, a memory integrated circuit (IC) is defined inside the atomizing assembly 10 for storing information such as the available smoking times. As an IC for storing data, in this embodiment, the memory integrated circuit whose model is DS2431 is used. In addition, other models of memory integrated circuits such as DS2431, 11AA010, CAT24C01 and the like may be used for the memory integrated circuit depending on the actual use situation. As shown in FIG. 7, the memory integrated circuit DS2431 comprises six pins (1-I/O, 2-GND, 3-NC, 4-NC, 5-NC and 6-NC), and a connector JP1 of the interface circuit 101 is provided with four terminals (1 to 4) in which the terminal 2 and the terminal 1 of the connector JP1 are connected to the pin 1-I/O and the pin 2-GND, respectively, and the terminal 3 and the terminal 4 are connected to two ends of a heat generating resistance wire R1 in the atomization circuit 102.

The specific working principle is shown as following: when the battery assembly 20 detects the user's smoking action and the battery assembly 20 is physically connected to the atomizing assembly 10 through the interface circuit 101, a controller in the battery assembly 20 communicates with the DS2431 through the terminal 2 of the connector JP1 and a data inputting and outputting pin 1-I/O of the DS2431 to read the available smoking time stored in the DS2431 and compare the available smoking time with the first preset value. If currently available smoking time is larger than the first preset value, it indicates that the amount of the current remaining e-liquid of the electronic cigarette is sufficient and the user can continue to smoke, then the battery assembly 20 supplies electrical power to the resistance wire R1 to make it generate heat through the terminals (3, 4) of the connector JP1, and after the user's present smoking is completed, the battery assembly 20 calculates the smoking time and updates the available smoking time in the memory integrated circuit based on the present smoking period to obtain the new available smoking time.

If the currently available smoking time is less than or equal to the first preset value, the battery assembly 20 outputs the prompt information for reminding the user that the e-liquid is almost to be exhausted, and outputs the available smoking time and/or the available smoking times of the electronic cigarette, the embodiment in which the battery assembly 20 performs information outputting is described in the above "(1) information outputting", and the description thereof will not be repeated here. Further, the battery assembly 20 compares the available smoking time with the second preset value, if the currently available smoking time is greater than the second preset value (i.e., the usage time corresponding to the minimum usable amount of the e-liquid), it indicates that the amount of the current remaining e-liquid of the electronic cigarette is not sufficient, but the user still can continue smoking, then the battery assembly 20 supplies electrical power to the resistance wire R1 to make it generate heat through the terminals (3, 4) of the connector JP1, and after the user's present smoking is completed, the battery assembly 20 calculates the smoking time and updates the available smoking time in the memory integrated circuit based on the present smoking duration to obtain the new available smoking time. In contrast, if the currently available smoking time is less than or equal to the second preset value, it indicates that the electronic cigarette currently has no remaining e-liquid, the user can not continue smoking, the battery assembly 20 stops to supply the electrical power to the resistance wire R1, i.e., the atomization circuit 102 is disconnected from the power supply.

In a specific implementation process, every time the user smokes, the microcontroller 203 in the battery assembly 20 subtracts the present smoking period from the available smoking time stored in the memory integrated circuit inside the atomizing assembly 10 and then updates the available smoking time stored in the memory integrated circuit; for instance, the available smoking time pre-stored in the memory integrated circuit is 12 hours, when the user smokes, the microcontroller 103 in the battery assembly 20 reads the value of 12 hours of the available smoking time from the memory integrated circuit of the atomizing assembly 10, after one smoking, if a present smoking period is 1 minute, the microcontroller subtracts 1 minute from the 12 hours, updates the available smoking time into 11 hours and 59 minutes, and then, writes back the 11 hours and 59 minutes to the memory integrated circuit of the atomizing assembly 10. The first preset value can be set to 4 hours, the second preset value can be set to 1 minute, then, when the available smoking time read by the microcontroller is greater than or equal to 4 hours, the battery assembly 10 supplies electrical power to the resistance wire R1; when the available smoking time is less than 4 hours and greater than 1 minute, the battery assembly 10 outputs the prompt information for reminding the user that the e-liquid is almost to be exhausted, and outputs the available smoking time and/or the available smoking times of the electronic cigarette as well, and further supplies electrical power to the resistance wire R1; when the available smoking time is less than or equal to 1 minute, the battery assembly 20 stops to supply electrical power to the resistance wire R1.

2) Case 2: This function is controlled and realized by the main circuit 103; in this case, the main circuit 103 has both a storage function for storing the usable smoking time and a control function of controlling the atomization circuit 102 to be turned off based on the available smoking time and controlling the atomization circuit 102 to turn on and update the available smoking time.

A, the control function and the storage function are realized by one chip.

Figure 8:
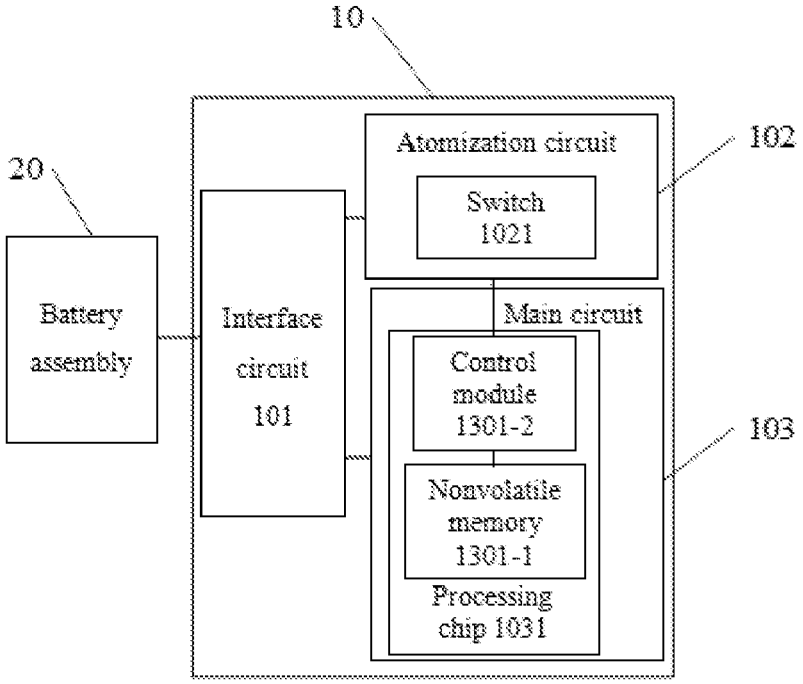
FIG. 8 is a structural block diagram showing the structure of a second type of the electronic cigarette provided by an embodiment of the present invention.

Specifically, referring to FIG. 8, the main circuit 103 comprises a processing chip 1031 in which a nonvolatile memory 1031-1 is defined, and the nonvolatile memory 1031-1 is configured for calculating the available smoking time based on the actual turn-on time of the atomization circuit 102, and providing the available smoking time to the battery assembly 20 when being electrically connected to the battery assembly 20, so that the battery assembly 20 outputs the prompt message to remind the user that the -e-liquid is almost to be exhausted and outputs the available smoking time and/or the available smoking times of the electronic cigarette as well, when the available smoking time is less than or equal to the first preset value Information; the processing chip 1031 further comprises a control module 1031-2 connected to the atomization circuit 102 and configured for obtaining the available smoking time from the nonvolatile memory 1031-1 after being electrically connected to the battery assembly 20 through the interface circuit 101, and the control module 1031-2 is further configured for directly controlling the atomization circuit 102 to be in the turn-off state when the available smoking time is less than or equal to the second preset value; specifically, the atomization circuit 102 comprises a switch 1021; therein the control module 1031-2 controls the switch 1021 to be in a turn-off state when the available smoking time is less than or equal to the second preset value, thereby realizing the turn-off state of the atomization circuit 102.

In addition, during a specific implementation process, the main circuit 103 is also configured for controlling the atomization circuit 102 to turn on to atomize the e-liquid when the available smoking time is less than or equal to the first preset value and greater than the second preset value, and the main circuit 103 is further configured for calculating a present smoking period and updating the available smoking time in the memory based on the present smoking period to obtain new available smoking time after a user's present smoking.

Figure 9:
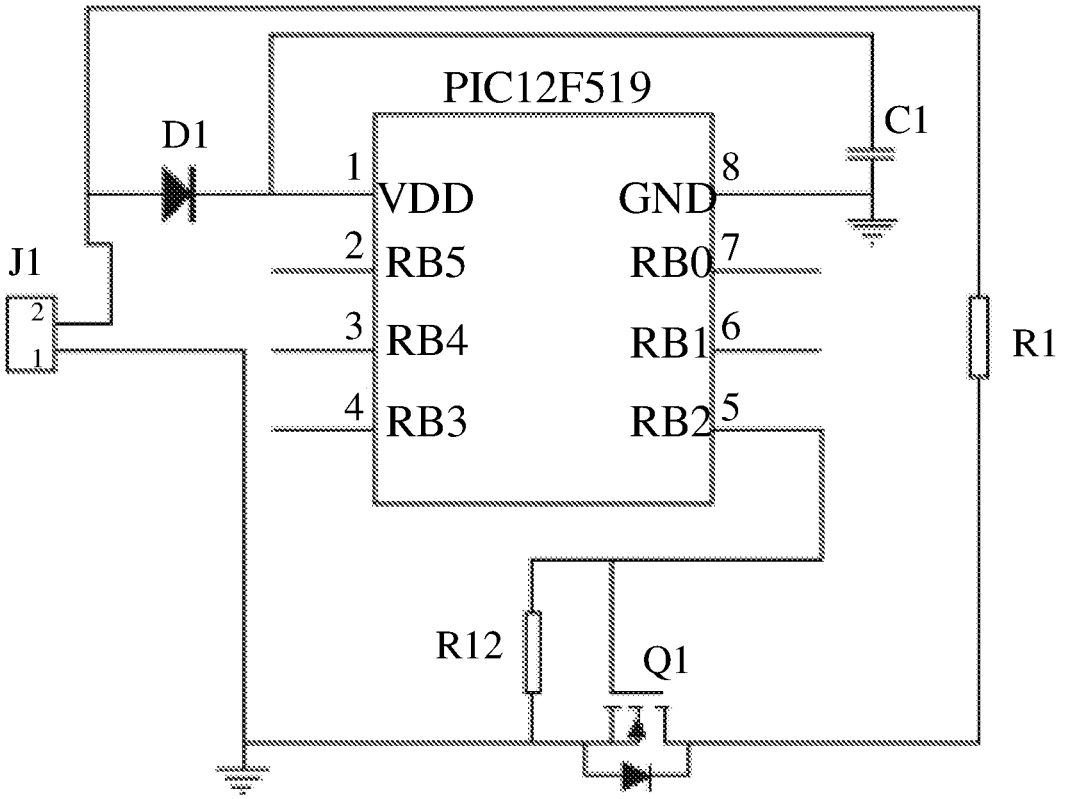
FIG. 9 is a circuit principle diagram of an atomizing assembly based on a microcontroller according to an embodiment of the present invention.

In the specific implementation process, referring to FIG. 9, the processing chip 1031 is a single-chip microcontroller PIC12F519 applied with a FLASH memory (i.e., a nonvolatile memory 1031-1), and the value of the smoking times may be stored in the FLASH memory or a program ROM; a connector J1 of the interface circuit 101 is provided with two terminals (1, 2), the terminal 1 is grounded, the terminal 2 is connected to a power supply pin 1-VDD of the single-chip microcontroller PIC12F519 through a diode D1; one end of capacitor C1 is connected to a diode D1, the other end of the capacitor C1 is grounded; the switch 1021 is applied as a MOSFET switch Q1, a source of the switch Q1 is connected to a pin 5-RB2 of the single-chip microcontroller PIC12F519. A resistor R12 is a discharge resistor provided between a gate and the source of the switch Q1, one end of the resistance wire R1 is connected to the terminal 2 of the connector J1, and the other end of the resistance wire R1 is connected to the ground through the switch Q1 (i.e., the other end of the resistance wire R1 is connected to the terminal 1 of the connector J1).

The working principle is shown as following: when the battery assembly 20 detects the user's smoking action and the battery assembly 20 is physically connected to the atomizing assembly 10 through the interface circuit 101, the battery assembly 20 supplies electrical power to modules in the atomizing assembly 10 through the terminals (1, 2) of the connector J1. Specifically, the capacitor C1 is charged by the diode D1 and the single-chip microcontroller PIC12F519 is started to operate after charging, at this time, the switch Q1 is turned off so that the resistance wire R1 is not turned on. After the single-chip microcontroller PIC12F519 works, a logic control module inside the single-chip microcontroller PIC12F519 (i.e., the control module 1031-2 in FIG. 8, and is not shown in FIG. 9) checks the available smoking time stored in the FLASH or the program ROM, and compares the available smoking time with the second preset value (Specific comparison methods are the same with those of the technical solution shown in FIG. 7 and do not repeat here), when a comparison result shows that the electronic cigarette can continue to be smoked, the single-chip microcontroller PIC12F519 outputs high level HIGH through the pin 5-RB2, so that the switch Q1 is turned on to operate, the resistance wire R1 is connected to the electrical power to perform normal smoking; when a comparison result shows that the electronic cigarette can not continue to be smoked, the single-chip microcontroller PIC12F519 outputs low level LOW through the pin 5-RB2, so that the switch Q1 can not be turned on, then the resistance wire R1 can not work since the resistance wire R1 is disconnected from the electrical power. The method of updating the available smoking time stored in the FLASH or the program ROM is also the same as that shown in FIG. 7.

B, the control function and the storage function are realized through different chips, respectively.

Figure 10:
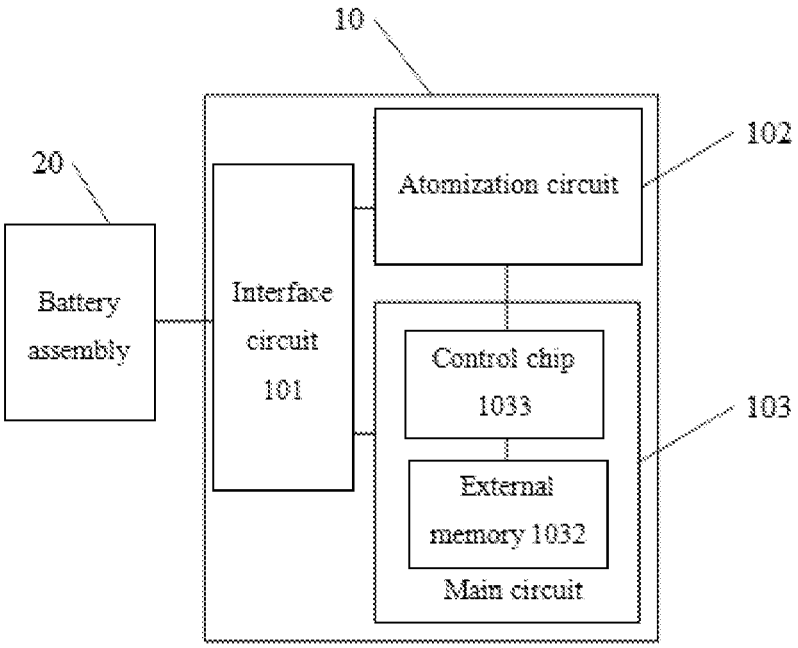
FIG. 10 is a structural block diagram showing the structure of a third type of electronic cigarette provided by an embodiment of the present invention.

Specifically, referring to FIG. 10, the main circuit 103 comprises: an external memory 1032 configured for calculating available smoking time based on the actual turn-on time of the atomization circuit 102, and providing the available smoking time to the battery assembly 20 when being electrically connected to the battery assembly 20, so that when the available smoking time is less than or equal to the first preset value, the battery assembly 20 outputs the prompt message is to remind the user that e-liquid is almost to be exhausted and outputs the available smoking time and/or available smoking times of the electronic cigarette; a control chip 1033 connected to the external memory 1032 and the atomization circuit 102, the control chip 1033 is configured for obtaining the available smoking time from the external memory 1032 after being electrically connected to the battery assembly 20 through the interface circuit 101, and the control chip 1033 is further configured for directly controlling the atomization circuit 102 to be in a turn-off state when the available smoking time is less than or equal to the second preset value.

Figure 11:
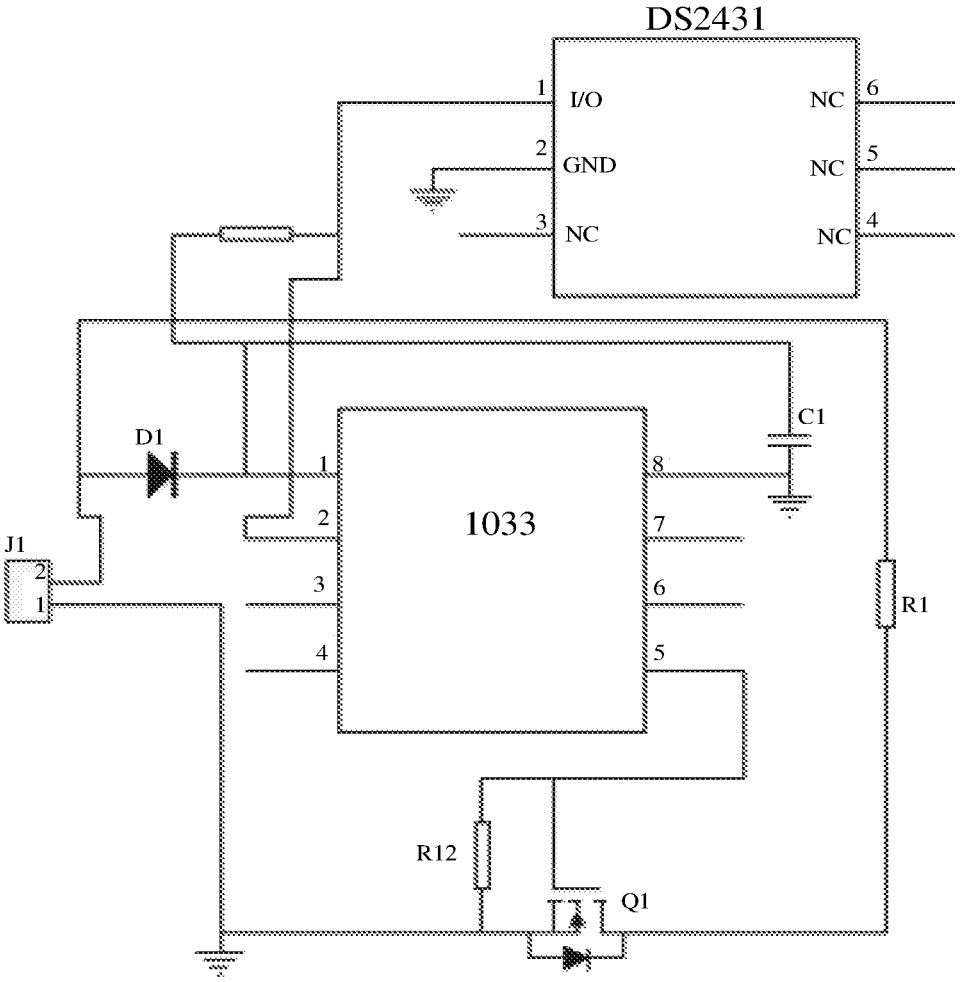
FIG. 11 is a circuit principle diagram of an atomizing assembly based on a microcontroller and a memory integrated circuit provided in an embodiment of the present invention.

Referring to FIG. 11, in the present embodiment, when the control chip 1033 which has been selected does not comprise a nonvolatile memory, an external memory 1032 connected the control chip 1033 may be provided outside the control chip 1033, such as DS2431, ST34C02, and other models of nonvolatile memory. As shown in FIG. 11, a peripheral circuit of the control chip 1033 is basically the peripheral circuit of the single-chip microcontroller PIC12F519 in the above embodiment (shown in FIG. 9). Certainly, connecting methods between the control chip 1033 and pins of the external memory 1032 (e.g., DS2431) are based on a model of the control chip 1033 to be selected, the connecting methods may be specifically referred to an application manual of the control chip 1033 and the external memory 1032, and are not specifically limited thereto. Working principles are the same with those shown in the FIG. 9, function of the external memory 1032 corresponds to the function of the nonvolatile memory 1031-1, and function of the control chip 1033 corresponds to the function of the control module 1031-2, they are not repeated here one by one.

3) Case 3: The Function is Controlled by the Main Circuit 103 and the Battery Assembly 20 Together;

Specifically, on the basis of the circuits of the second case described above, the operating principle of the third case is shown as following: when the user's smoking action is detected, the microcontroller 203 in the battery assembly 20 reads the available smoking time from the memory in the main circuit 103, compares the available smoking time with the first preset value and the second preset value, and then generates a control command for controlling the atomization circuit 102 to be in the turn-off state when the available smoking time is less than the second preset value, and sends the control command to the controller in the main circuit 103 so that the controller controls the atomization circuit 102 to be in the turn-off state. In addition, when the available smoking time is greater than the second preset value, the battery assembly 20 generates a control command for controlling the atomization circuit 102 to turn on and sends the control command to the controller in the main circuit 103 so that the controller controls the atomization circuit 102 to turn on. After the present smoking is finished, the available smoking time originally stored is updated through the control of the microcontroller 203 in the battery assembly 20 or the controller in the main control circuit 103.

Certainly, in a specific implementation process, according to the specific design of the electronic cigarette circuits, when the microcontroller 203 is provided in the battery assembly 20, regardless of whether or not the main circuit 103 comprises a controller, the turn-on and turn-off state of the atomization circuit 102 can be directly controlled by the microcontroller 203. Similarly, when the controller is provided in the main circuit 103, regardless of whether or not the microcontroller 203 is defined in the battery assembly 20, the main circuit 103 can directly control the battery assembly 20 to output the prompt message and control the atomization circuit 102 to turn on or turn off; they are not listed here one by one. Further, in the specific implementation process, in order to be able to accurately determine whether or not the atomization circuit 102 is actually turned on, and whether or not the resistance wire R1 actually performs atomization of the e-liquid, so as to make the calculation of the available smoking time more accurate, it is determined whether or not the atomization circuit 102 is actually turned on and whether or not the resistance wire R1 actually performs the atomization of the e-liquid by a current detection program.

Figure 12:
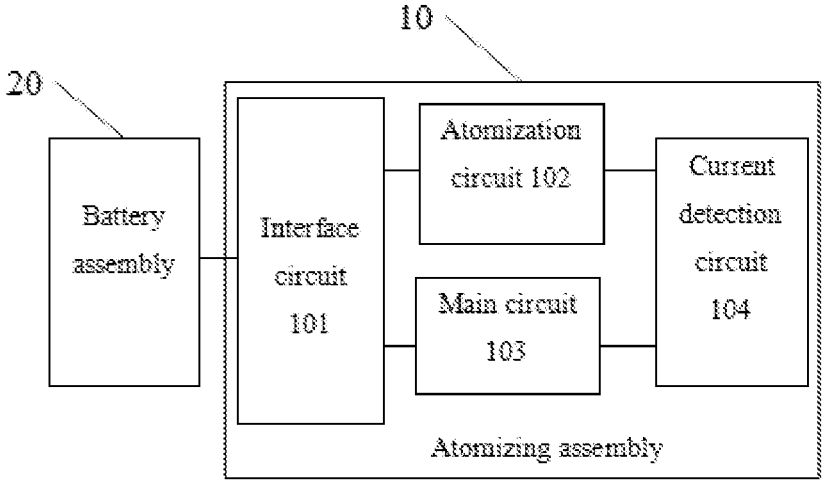
FIG. 12 is a structural block diagram showing the structure of a fourth type of electronic cigarette provided by an embodiment of the present invention.

Specifically, referring to FIG. 12, the atomizing assembly 10 further comprises a current detection circuit 104 connected to the atomization circuit 102 and the main circuit 103, the current detection circuit 104 is configured for detecting a current signal of the atomization circuit 102 after the main circuit 103 and the battery assembly 20 are electrically connected to each other, and then feeding back an actual turn-on situation of the atomization circuit 102 to the main circuit 103 based on the current signal.

Figure 13:
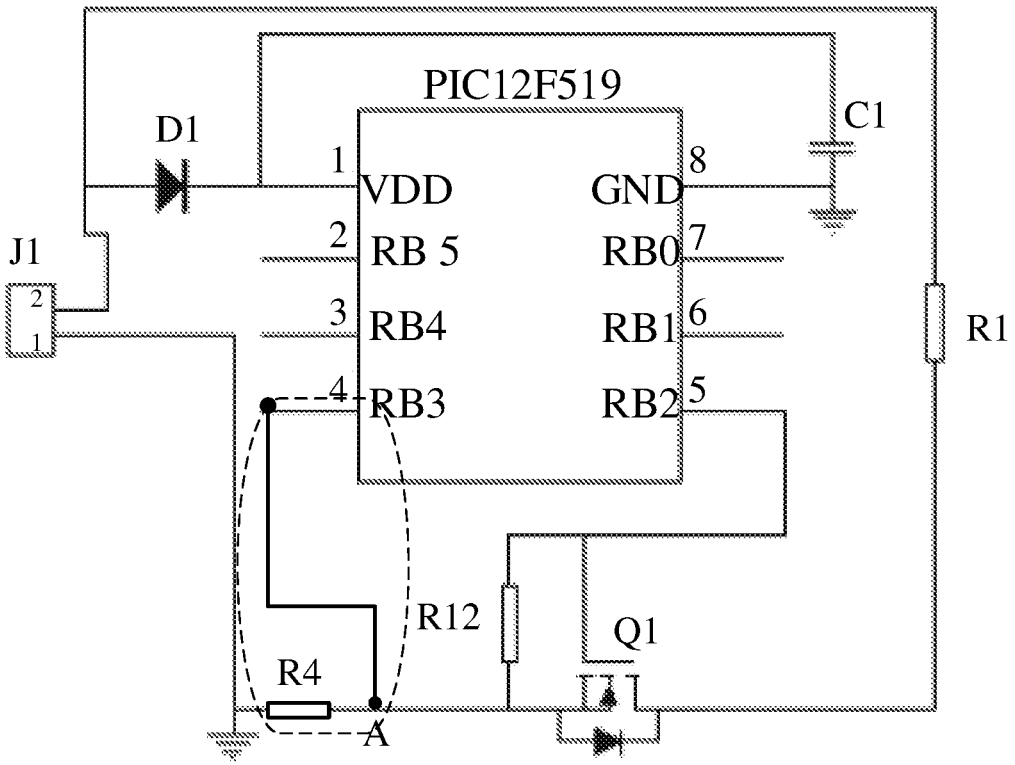
FIG. 13 is a circuit principle diagram for detecting whether or not the atomization circuit is actually turned on in an embodiment of the present invention.

Specifically, referring to FIG. 13, improvement is made on the basis of FIG. 9, and the improvement is shown in the section circled in the broken line in FIG. 13, and a resistor R4 is connected in series between the gate of the switch Q1 and the ground, a signal line is connected from a connecting line between the resistor R4 and the gate of the switch Q1 to connect to a free pin (such as a pin 4-RB3) of the single-chip microcontroller PIC12F519. Operating principles of the current detection circuit are designed as following: when the switch Q1 is turned on and the resistance wire R1 is connected to the battery assembly 20, the gate of the switch Q1 generates a pressure differential so that the pin 4-RB3 of the microcontroller PIC12F519 obtains a high level signal, and the atomization circuit 102 is determined to be actually in a turn-on state based on this high level signal, and the calculation of the available smoking time can be performed; when the switch Q1 is turned on and the resistance wire R1 is not connected to the battery assembly 20, that is, the resistance wire R1 is disconnected due to a fault, the pin 4-RB3 of the microcontroller PIC12F519 obtains a low level signal, then the atomization circuit 102 is determined to be not actually in the turned-on state based on this low level signal and the calculation of the available smoking time is not performed.

In summary, in the embodiment of the present application, internal circuits of the electronic cigarette are reasonably planned and mainly divided into two parts: the battery assembly and the atomizing assembly; the main circuit for calculating the amount of the remaining e-liquid is defined in the atomizing assembly, so that when the atomizing assembly is disconnected from the power supply, a control unit that controls the atomization circuit to turn on and turn off based on the available smoke time corresponding to the amount of the remaining e-liquid can not operate on the available smoking time stored in the atomizing assembly; Further, the main circuit calculates the available smoking time based on the actual turn-on time of the atomization circuit so that when the main circuit is connected to the battery assembly and the atomization circuit is disconnected (e.g., the resistance wire is faulty), the control unit is impossible to operate on the available smoking time stored in the atomizing assembly; the available smoking time must be updated after determining that the atomization circuit actually turns on and the resistance wire actually works. It achieves technical effects that when the available smoking time is being limited, the available smoking time and the amount of the remaining e-liquid are matched well to effectively ensure product consistency.

In addition, by providing the interface circuit inside the atomizing assembly for achieving a detachable assembly connection of the battery assembly and the atomizing assembly, the connection points are concentrated, the battery assembly and the atomizing assembly communicate with each other through the interface circuit, then communication signal is clear, control logic is simplified. The main circuit design is diversified, the main circuit may be designed based only on a memory integrated circuit, and may also be designed based on both a control chip (such as a single-chip microcontroller) and a memory integrated circuit to meet a wide range of application requirements; and chips used in the atomizing assembly are inexpensive, when the calculated available smoking time shows that the electronic cigarette can no longer continue to be used, it is no need to rewrite programs, the user can directly replace the atomizing assembly as a whole. Thus, it is easy to operate, convenient and efficient, and effectively improves user's experience.

It will be understood by those skilled in the art that the embodiment of the present invention may be provided as a method, system, or computer program product. Thus, the present invention may take the form of a complete hardware embodiment, a complete software embodiment, or a combination embodiment of both software and hardware aspects. Moreover, The present invention may take the form of a computer program product implemented on one or more computer usable storage media containing computer usable program code therein (comprising but not limited to disk storage, CD-ROM, optical memory, etc.).

While the preferred embodiments of the present invention have been described, those skilled in the art will be able to make further changes and modifications to these embodiments upon the knowledge of the basic inventive concepts. Accordingly, the appended claims are intended to be construed as all changes and modifications that fall within the preferred embodiments and the scope of the invention.

It will be apparent to those skilled in the art that various changes and modifications can be made in the present invention without departing from the spirit and scope of the invention. In this manner, if the modifications and variations of the invention are within the scope of the appended claims and the equivalents of the present invention, such modifications and variations are intended to be comprised by the present invention.

The invention claimed is:

1. A method for controlling electronic cigarette, wherein a memory of the electronic cigarette stores a first preset value and a second preset value which are relating to an amount of e-liquid, and available smoking time updated after each smoking to indicate the amount of current remaining e-liquid of the electronic cigarette, the second preset value is less than the first preset value; the method comprising following steps:

reading the available smoking time when an atomization circuit of the electronic cigarette is in a turn-off state and the electronic cigarette detects a user's smoking action;

determining whether or not the available smoking time is equal to or less than the first preset value to obtain a first determination result;

outputting a prompt message to remind the user that e-liquid is almost to be exhausted, and outputting the available smoking time and/or available smoking times of the electronic cigarette, when the first determination result is YES;

determining whether the available smoking time is greater than the second preset value to obtain a second determination result;

controlling the atomization circuit to stay in the turn-off state when the second determination result is NO.

2. The method for controlling electronic cigarette according to claim 1, wherein after performing the step of determining whether or not the available smoking time is equal to or less than the first preset value to obtain a first determination result, the method further comprises following steps:

controlling the atomization circuit to turn on to atomize the e-liquid when the first determination result is NO, calculating a present smoking period and updating the available smoking time in the memory based on the present smoking period to obtain new available smoking time after a user's present smoking.

3. The method for controlling electronic cigarette according to claim 1, wherein after performing step of determining whether the available smoking time is greater than the second preset value to obtain a second determination result, the method further comprises following steps:

controlling the atomization circuit to turn on to atomize the e-liquid when the second determination result is YES;

calculating a present smoking period and updating the available smoking time in the memory based on the present smoking period to obtain new available smoking time after a user's present smoking.

4. The method for controlling electronic cigarette according to claim 1, wherein while performing the step of controlling the atomization circuit to stay in the turn-off state when the second determination result is NO, the method further comprises step of:

outputting a reminding message to remind the user that the e-liquid has been exhausted.

5. An electronic cigarette comprising an atomizing assembly (10) and a battery assembly (20);

wherein the atomizing assembly (10) is provided with an interface circuit (101), an atomization circuit (102) and a main circuit (103); the interface circuit (101) is configured for detachably connecting to the battery assembly (20), the atomization circuit (102) and the main circuit (103) are connected to the interface circuit (101);

wherein the main circuit (103) is configured for calculating available smoking time based on actual turn-on time of the atomization circuit (102) after being electrically connected to the battery assembly (20) through the interface circuit (101), so that when the available smoking time is less than or equal to the first preset value, a prompt message is outputted to remind a user that e-liquid is almost to be exhausted and the available smoking time and/or available smoking times of the electronic cigarette is outputted; and when the available smoking time is less than or equal to a second preset value, the atomization circuit (102) is controlled to be in a turn-off state, wherein the main circuit (103) is configured for calculating the available smoking time based on the actual turn-on time of the atomization circuit (102), and providing the available smoking time to the battery assembly (20) when being electrically connected to the battery assembly (20);

wherein the battery assembly (20) is configured for outputting the prompt message to remind the user that e-liquid is almost to be exhausted and outputting the available smoking time and/or the available smoking times of the electronic cigarette, when the available smoking time is less than or equal to the first preset value; and wherein the main circuit (103) or the battery assembly (20) is further configured for controlling the atomization circuit (102) to be in the turn-off state when the available smoking time is less than or equal to the second preset value.

6. The electronic cigarette according to claim 5, wherein the battery assembly (20) is configured for controlling the atomization circuit (102) to turn on to atomize the e-liquid when the available smoking time is greater than the first preset value, and the battery assembly (20) is further configured for calculating a present smoking period and updating the available smoking time in the main circuit (103)

based on the present smoking period to obtain new available smoking time after a user's present smoking.

7. The electronic cigarette according to claim 5, wherein the main circuit (103) or the battery assembly (20) is configured for controlling the atomization circuit (102) to turn on to atomize the e-liquid when the available smoking time is less than or equal to the first preset value and greater than the second preset value, and the main circuit (103) or the battery assembly (20) is further configured for calculating a present smoking period and updating the available smoking time in the main circuit (103) based on the present smoking period to obtain new available smoking time after a user's present smoking.

8. The electronic cigarette according to claim 5, wherein the main circuit (103) is a memory integrated circuit that provides the available smoking time to the battery assembly (20) through the interface circuit (101); and wherein the battery assembly (20) is configured for outputting the prompt message to remind the user that e-liquid is almost to be exhausted, and outputting the available smoking time and/or available smoking times of the electronic cigarette, when the available smoking time is less than or equal to the first preset value; the battery assembly (20) is further configured for controlling the atomization circuit (102) to be in the turn-off state when the available smoking time is less than or equal to the second preset value.

9. The electronic cigarette according to claim 5, wherein the main circuit (103) comprises a processing chip (1031) in which a nonvolatile memory (1031-1) is defined;

wherein the nonvolatile memory (1031-1) is configured for calculating the available smoking time based on the actual turn-on time of the atomization circuit (102), and the nonvolatile memory (1031-1) is further configured for providing the available smoking time to the battery assembly (20) when being electrically connected to the battery assembly (20), so that when the available smoking time is less than or equal to the first preset value, the battery assembly (20) outputs the prompt message to remind the user that e-liquid is almost to be exhausted and outputs the available smoking time and/or the available smoking times of the electronic cigarette; and wherein the processing chip (1031) further comprises a control module (1031-2) connected to the atomization circuit (102) and configured for obtaining the available smoking time from the nonvolatile memory (1031-1) after being electrically connected to the battery assembly (20) through the interface circuit (101), and the control module (1031-2) is further configured for directly controlling the atomization circuit (102) to be in the turn-off state when the available smoking time is less than or equal to the second preset value.

10. The electronic cigarette according to claim 9, wherein the atomization circuit (102) comprises a switch (1021); and wherein the control module (1031-2) controls the switch (1021) to be in a turn-off state when the available smoking time is less than or equal to the second preset value, thereby realizing the turn-off state of the atomization circuit (102).

11. The electronic cigarette according to claim 5, wherein the main circuit (103) comprises:

an external memory (1032) configured for calculating the available smoking time based on the actual turn-on time of the atomization circuit (102), and providing the available smoking time to the battery assembly (20) when being electrically connected to the battery assembly (20), so that when the available smoking time is less than or equal to the first preset value, the battery assembly (20) outputs the prompt message is to remind the user that e-liquid is almost to be exhausted and outputs the available smoking time and/or available smoking times of the electronic cigarette;

a control chip (1033) connected to the external memory (1032) and the atomization circuit (102), the control chip (1033) is configured for obtaining the available smoking time from the external memory (1032) after being electrically connected to the battery assembly (20) through the interface circuit (101), and the control chip (1033) is further configured for directly controlling the atomization circuit (102) to be in the turn-off state when the available smoking time is less than or equal to the second preset value.

12. The electronic cigarette according to claim 5, wherein the atomizing assembly (10) further comprises:

a current detection circuit (104) connected to the atomization circuit (102) and the main circuit (103), the current detection circuit (104) is configured for detecting a current signal of the atomization circuit (102) after that the main circuit (103) and the battery assembly (20) are electrically connected to each other, and then feeding back an actual turn-on situation of the atomization circuit (102) to the main circuit (103) based on the current signal.

13. The electronic cigarette according to claim 5, wherein the battery assembly (20) comprises:

a power supply circuit (201); a smoking action detection circuit (202) connected to the power supply circuit (201);

a microcontroller (203) connected to the power supply circuit (201) and the smoking action detection circuit (202) and configured for obtaining the available smoking time from the main circuit (103) when the smoking action detection circuit (202) detects a user's smoking action;

a display screen (204) connected to the power supply circuit (201) and the microcontroller (203) for displaying relevant information of the electronic cigarette when necessary;

the microcontroller (203) compares the available smoking time with the first preset value, when the available smoking time is less than or equal to the first preset value, the microcontroller (203) generates the prompt message configured for controlling the display screen (204) to display to remind the user that the e-liquid is almost to be exhausted, and the microcontroller (203) further outputs a control command of the available smoking time and/or the available smoking times of the electronic cigarette and sends the control command to the display screen (204).

14. The electronic cigarette according to claim 5, wherein the battery assembly (20) comprises:

a power supply circuit (201);

a smoking action detection circuit (202) connected to the power supply circuit (201);

a microcontroller (203) connected to the power supply circuit (201) and the smoking action detection circuit (202) and configured for obtaining the available smoking time from the main circuit (103) when the smoking action detection circuit (202) detects a user's smoking action;

a wireless communication module (205) connected to the power supply circuit (201) and the microcontroller (203) for transmitting relevant information of the electronic cigarette to an external device by wireless communication, if necessary;

the microcontroller (203) compares the available smoking time with the first preset value, when the available smoking time is less than or equal to the first preset value, the microcontroller (203) generates the prompt message configured for controlling the wireless communication module (205) to output to the external device to remind the user that the e-liquid is almost to be exhausted, and the microcontroller (203) further outputs a control command of the available smoking time and/or the available smoking times of the electronic cigarette and sends the control command to the wireless communication module (205).

15. The electronic cigarette according to claim 14, wherein the wireless communication module (205) is a Bluetooth transceiver module.

16. The electronic cigarette according to claim 5, wherein the battery assembly (20) is further configured to output a reminding message for reminding the user that the e-liquid has been exhausted when the electronic cigarette controls the atomization circuit (102) to be in a turn-off state based on the available smoking time.

* * * * *